US006662787B2

(12) United States Patent
Fiorio

(10) Patent No.: US 6,662,787 B2
(45) Date of Patent: Dec. 16, 2003

(54) METHOD AND DEVICE FOR MONITORING THE FUEL/AIR RATIO OF THE MIXTURE OF AIR AND VAPOR BEING FED FROM THE OUTLET OF A FUEL VAPOR ACCUMULATOR

(75) Inventor: Luigino Fiorio, Scarmagno (IT)

(73) Assignee: Dayco Fuel Management S.p.A., Turin (IT)

( * ) Notice: Subject to any disclaimer, the term of this patent is extended or adjusted under 35 U.S.C. 154(b) by 35 days.

(21) Appl. No.: 09/995,000

(22) Filed: Nov. 26, 2001

(65) Prior Publication Data

US 2002/0139356 A1 Oct. 3, 2002

(30) Foreign Application Priority Data

Nov. 24, 2000 (IT) ..... TO2000A1106

(51) Int. Cl.[7] ..... F02M 33/02
(52) U.S. Cl. ..... 123/520
(58) Field of Search ..... 123/520, 519, 123/518, 516, 198 D

(56) References Cited

U.S. PATENT DOCUMENTS 5,216,995 A * 6/1993 Hosoda et al. ..... 123/520
5,329,909 A * 7/1994 Hosoda et al. ..... 123/520
5,609,141 A 3/1997 Matsuoka et al. ..... 123/520
5,680,849 A * 10/1997 Morikawa et al. ..... 123/520
5,746,187 A 5/1998 Ninomiya et al. ..... 123/520
6,119,662 A * 9/2000 Duty et al. ..... 123/520

FOREIGN PATENT DOCUMENTS

EP 0984154 A2 3/2000
GB 2329218 A 3/1999

* cited by examiner

*Primary Examiner*—Mahmoud Gimie
(74) *Attorney, Agent, or Firm*—Sheridan Ross PC

(57) ABSTRACT

A device for monitoring the fuel/air ratio, wherein a vapour accumulator receives at the inlet fuel vapour coming from a tank and an air flow (and feeds from the outlet towards an intake manifold of an engine a mixture of air and vapour. An electronic processor receives at the input at least information correlated to the flow rate of air Qa aspirated into the accumulator so as to calculate, on the basis of the flow rate of air Qa, the percentage p of vapour fed to the manifold in relation to the total of vapour and air aspirated into the accumulator.

8 Claims, 2 Drawing Sheets

METHOD AND DEVICE FOR MONITORING THE FUEL/AIR RATIO OF THE MIXTURE OF AIR AND VAPOR BEING FED FROM THE OUTLET OF A FUEL VAPOR ACCUMULATOR

The present invention relates to a method and device for monitoring the fuel/air ratio of the mixture of air and vapour being fed from the outlet of a fuel vapour accumulator.

BACKGROUND OF THE INVENTION

It is known that recent antipollution regulations provide for automobiles to be provided with a vapour accumulator (canister) designed to absorb the fuel vapours which are formed, while the vehicle is parked, by the liquid fuel contained in the vehicle's fuel tank. An accumulator of this type generally comprises a casing containing an activated carbon structure adapted to absorb the fuel vapour. An evaporative system is also provided which is adapted to carry out a vapour desorption stage (or scavenging) of the accumulator, in which the fuel stored in the activated carbon is desorbed and fed to the engine, in particular fed to the intake manifold of the engine. This evaporative system generally comprises a discharge duct which extends between an accumulator outlet and the intake manifold so as to utilise the vacuum created in the intake manifold when the engine is running and to provide a flow of air and vapour towards the intake manifold. The evaporative system further comprises an intake duct designed to allow the intake of air into the interior of said accumulator.

The evaporative systems of known type have a disadvantage in that the flow of air and vapour fed from the outlet is of variable and indeterminate composition; in particular, it is not possible to determine the percentage ratio of vapour fed to the manifold in relation to the total of vapour and air aspirated into the accumulator. Therefore, during the scavenging stage of the accumulator, a mixture of air and fuel is fed to the intake manifold, the percentage ratio of which mixture is not known. For this reason, during the aforementioned scavenging stage, the final air and fuel mixture which is fed to the engine may deviate from the stoichiometric ratio, which clearly brings about a deterioration in the emissions from the engine and in the operation of the catalytic converter.

SUMMARY OF THE INVENTION

The object of the present invention is to provide a device for monitoring the fuel/air ratio of the mixture of vapours being fed from the outlet of a fuel vapour accumulator.

This object is achieved by the present invention in that it relates to a device for monitoring the fuel/air ratio of the mixture of air and vapour being fed from the outlet of a fuel vapour accumulator of the type described in claim 1.

The present invention also relates to a method of monitoring the fuel/air ratio of the mixture of air and vapour being fed from the outlet of a fuel vapour accumulator of the type described in claim 6.

BRIEF DESCRIPTION OF THE DRAWINGS

The invention will now be described with reference to the accompanying drawings which illustrate a preferred non-restrictive embodiment, in which.

DETAILED DESCRIPTION OF THE INVENTION

Figure 1:
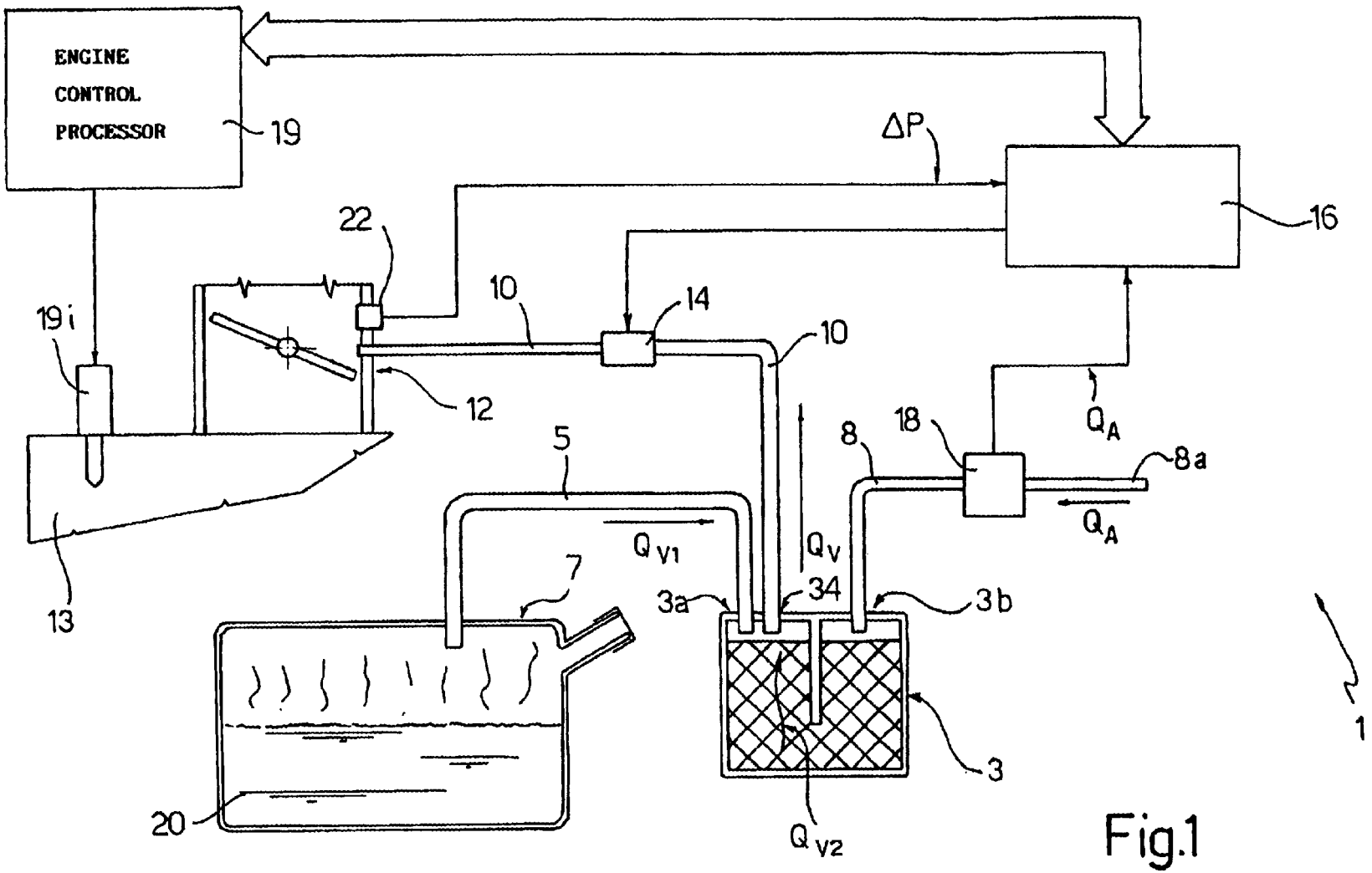
FIG. 1 illustrates schematically a device for monitoring the fuel/air ratio of the mixture of air and vapour being fed from the outlet of a fuel vapour accumulator designed in accordance with the present invention.

In FIG. 1 the reference numeral 1 generally denotes a device for monitoring the fuel/air ratio of the mixture of air and vapour being fed from the outlet of a fuel vapour accumulator In particular, the fuel vapour accumulator 3 (of known type—also known as a CANISTER) has a first inlet 3*a* connected, via a duct 5, to a fuel tank 7 and a second inlet 3*b* connected to an intake duct 8 which, at its free end 8*a*, provides an air intake. Furthermore, the vapour accumulator 3 has an outlet 34 which communicates via a duct 10 with the intake manifold 12 (partly illustrated) of a petrol engine (illustrated schematically).

A solenoid valve 14 is provided along the duct 10 to cut off the flow of air and fuel vapour coming from the accumulator 3 and directed towards the intake manifold 12. In particular, the solenoid valve 14 is controlled according to a mode of operation (of known type) in which opening and closing cycles of said solenoid valve are repeated iteratively; moreover, the opening time period may be controlled continuously so as to regulate the flow of air and vapour directed towards the intake manifold 12.

The device 1 for monitoring the fuel/air ratio further comprises an electronic processor 16 which controls via a driver (not shown) the length of time of the opening/closing cycles of the solenoid valve 14. In particular, it is possible to control the duty cycle K of the solenoid valve 14, which is defined as the ratio between the opening time Ton of the valve and the total opening and closing time Ton+Toff, i.e.:

$$K=T\text{on}/(T\text{on}+T\text{off})$$

A flow rate sensor 18 communicating with the electronic processor 16 is provided along the duct 8 and is adapted to measure the flow of air drawn in by the duct 8 towards the vapour accumulator 3. The processor 16 further communicates with an engine control processor 19 adapted to control the injection unit 19*i* of the engine 13. However, it is evident that the processors 16 and 19, which are shown as separate in FIG. 1, could be integrated with one another.

It is known that when a vehicle is parked (not shown) the fuel 20 (petrol) contained in the tank 7 evaporates partially and passes via the duct 5 into the accumulator 3, in which it is deposited. During the induction stroke of the engine 13 a vacuum is created in the intake manifold 12, which via the duct 10 returns fuel vapour from the accumulator 3 towards the intake manifold 12. Moreover, this vacuum takes part in the aspiration of air which passes through the duct 8 and is fed to the inlet 3*b* of the accumulator 3.

In particular, in the following description the reference numeral:

Qv1 denotes the flow rate of fuel vapour coming from the tank 7 (said vapours Qv1 are fed to the accumulator 3 via the duct 5);

Qv2 denotes the flow rate of petrol vapour released (desorbed) by the accumulator 3;

Qv denotes the vapour fed from the outlet of the accumulator 3—therefore, Qv is given by the sum of the vapour released by the accumulator and the vapour evaporated from the tank, i.e: Qv=Qv1+Qv2;

Qa denotes the flow rate of air fed to the accumulator 3 via the intake duct 8 (the flow rate Qa is detected by the sensor 18), and Qm denotes the flow rate of the mixture of air and vapour fed to the manifold 12 via the duct 10; Qm is equal to Qa+Qv and comprises the air drawn into the accumulator and the fuel vapour released by the accumulator 3.

Figure 2:
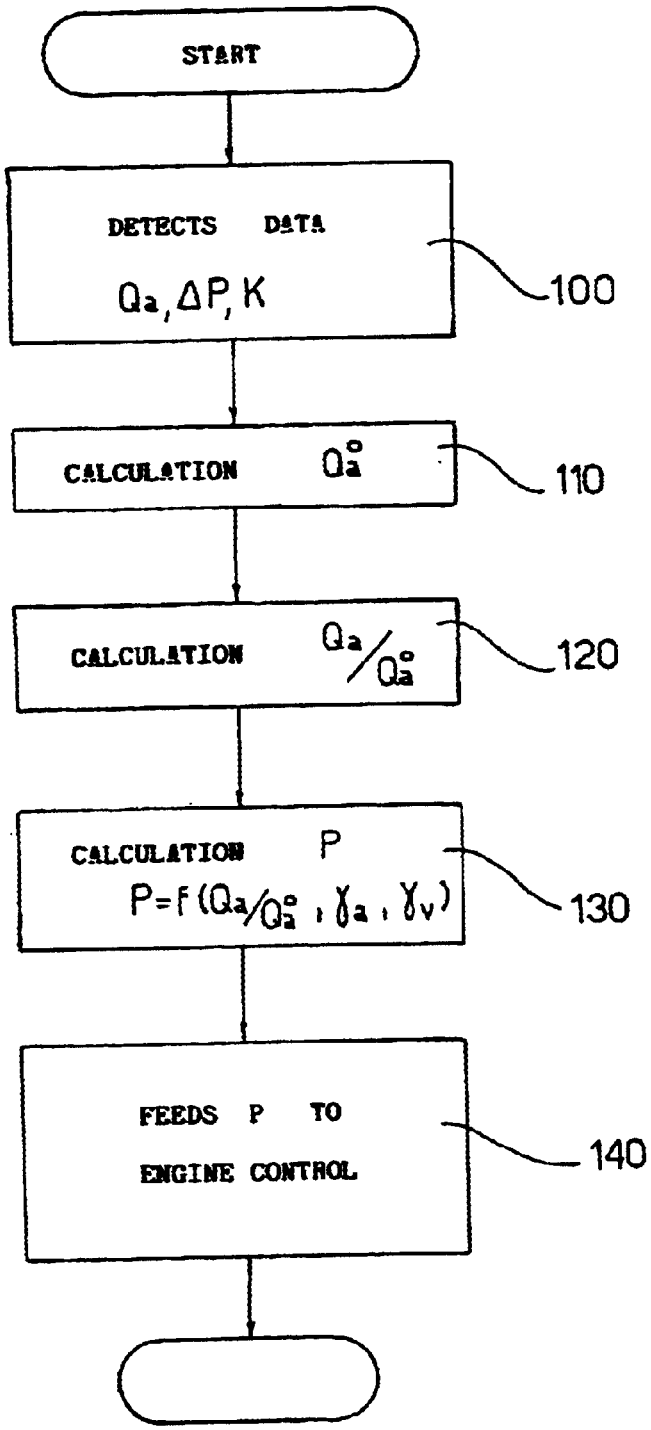
FIG. 2 illustrates a block diagram of the operations carried out by the device in FIG. 1.

FIG. 2 illustrates operations performed by the electronic processor 16 operating in accordance with the present invention.

Initially, a block 100 is reached which carries out the detection of a plurality of data, including:

the flow rate of air Qa aspirated towards the accumulator 3 (this information is obtained by means of the signal generated by the sensor 18);

the vacuum ΔP which is created in the intake manifold 12 (this information may be obtained by means of a pressure sensor 22 disposed in the intake manifold 12);

the duty cycle K with which the switching-over of the solenoid valve 14 is controlled.

The electronic processor 16 is also provided with a memory (not shown) in which are stored the values of a plurality of parameters, including:

the specific weight of the air γa;

the specific weight of the fuel vapour γv, and the passage section area A of the solenoid valve 14.

The block 100 is followed by a block 110 which calculates the flow rate of air Qa° which would pass through the solenoid valve 14 (i.e. the flow rate of air at the outlet of the accumulator 3 and directed towards the manifold 12) in the absence of vapour coming from the accumulator 3.

$$Qa^0 = KA\sqrt{\frac{\Delta P}{\gamma a}} \tag{1}$$

in which ΔP represents the vacuum in the intake manifold 12, γa, represents the specific weight of the air, A represents the passage section of the solenoid valve 14 and K takes into account the duty cycle with which the switching-over of the valve 14 is controlled.

The block 110 is followed by a block 120 which calculates the ratio between the flow rate of air Qa fed to the accumulator 3 and the flow rate of air Qa° which would pass through the solenoid valve 14 in the absence of vapour coming from the accumulator, i.e.: Qa/Qa°.

The block 120 is followed by a block 130 which calculates the percentage P of vapour fed to the manifold 12 in relation to the total of vapour and air drawn into the accumulator, i.e.:

$$p = \frac{Qv}{Qv + Qa} \tag{2}$$

The calculation of p is carried out on the basis of the following quantities:

the ratio Qa/Qa° between the rate of flow of air Qa fed to the accumulator 3 and the flow rate of air Qa° which would flow through the solenoid valve 14 in the absence of vapours coming from the accumulator 3;

the specific weight of the air γa, and the specific weight of the vapour γv.

In particular, the calculation of p is carried out according to the following formula (3):

$$p = 0.5\left[2 - \left(1 - \frac{\gamma v}{\gamma a}\right)\left(\frac{Qa}{Qa^0}\right)^2\right] - 0.5\sqrt{\left[2 - \left(1 - \frac{\gamma v}{\gamma a}\right)\left(\frac{Qa}{Qa^0}\right)^2\right]^2 - 4\left[1 - \left(\frac{Qa}{Qa^0}\right)^2\right]} \tag{3}$$

The block 130 is followed by a block 140 which feeds the previously calculated value of p to the engine control processor 19 which ensures the metering of the quantity of fuel fed by the injectors 19*i*, taking into account the value of p in the following manner.

Once the value of P is known, calculated with the expression (3) from block 130, and of Qa (measured by the sensor 18), it is possible to calculate from the expression (2) the value of Qv. Since the total metering of the engine should be stoichiometric, the value of the flow rate QF of petrol fed by the injectors can be calculated by the following formula:

$$14.56 = \frac{Ga + Qa\gamma a}{GF + Qv\gamma v}$$

in which:

Ga is the mass flow rate of air aspirated by the engine and measured by the vehicle's flow meter, and GF is the mass flow rate of petrol injected into the intake manifold by the injectors.

In this way the final mixture of air and fuel which is fed to the engine 13 does not deviate from the stoichiometric ratio even during the scavenging stage of the accumulator 3.

There will now be briefly described the mathematical process which resulted in the definition of the formula for the calculation of p.

The flow rate of the mixture of air and vapour which flows towards the manifold 12 via the duct 10 can be expressed in accordance with Bemouilli's law, with the following formula:

$$Qm = KA\sqrt{\frac{\Delta P}{\gamma m}} \tag{4}$$

in which ΔP represents the vacuum in the intake manifold 12, γm represents the specific weight of the air and vapour mixture, A represents the passage section of the solenoid valve 14 and K takes into account the duty cycle with which the switching-over of the valve 14 is controlled.

Furthermore, the specific weight of the air and vapour mixture can be expressed by way of the following equation:

$$\gamma m = \frac{Qa\gamma a + Qv\gamma v}{Qa + Qv} \tag{5}$$

In turn the rate of air flow Qa° which would flow through the solenoid valve 14 in the absence of vapour coming from the accumulator can be expressed in accordance with Bemouilli's law as:

$$Qa^0 = KA\sqrt{\frac{\Delta P}{\gamma a}} \tag{6}$$

in which ΔP represents the vacuum in the intake manifold 12, γa represents the specific weight of the air, A represents the passage section of the solenoid valve 14 and K takes into account the duty cycle with which the switching-over of the valve 14 is controlled.

By compounding (4) with (6) one arrives at:

$$Qm = Qa^0\sqrt{\frac{\gamma a}{\gamma m}} \tag{7}$$

and expressing the definition of p $$p = \frac{Qv}{Qv + Qa} = \frac{Qv}{Qm} = \frac{Qm - Qa}{Qm} = 1 - \frac{Qa}{Qm} = 1 - \frac{Qa}{Qa^0\sqrt{\gamma}\,a}\sqrt{\frac{Qa\gamma a + Qv\gamma v}{Qm}}$$

namely:

$$p = 1 - \frac{Qa}{Qa^0\sqrt{\gamma a}}\sqrt{\frac{Qa\gamma a}{Qm} + p\gamma v} \tag{8}$$

from which:

$$p = 1 - \frac{Qa}{Qa^0\sqrt{\gamma a}}\sqrt{\frac{(Qm - Qv)\gamma a}{Qm} + p\gamma v} \tag{9}$$

$$p = 1 - \frac{Qa}{Qa^0\sqrt{\gamma a}}\sqrt{(1 - p)\gamma a + p\gamma v} \tag{10}$$

$$p = 1 - \frac{Qa}{Qa^0\sqrt{\gamma a}}\sqrt{\gamma a - p(\gamma a - \gamma v)} \tag{11}$$

therefore, from the expression (11) the value of p can be obtained as:

$$p = 0.5\left[2 - \left(1 - \frac{\gamma v}{\gamma a}\right)\left(\frac{Qa}{Qa^0}\right)^2\right] - 0.5\sqrt{\left[2 - \left(1 - \frac{\gamma v}{\gamma a}\right)\left(\frac{Qa}{Qa^0}\right)^2\right]^2 - 4\left[1 - \left(\frac{Qa}{Qa^0}\right)^2\right]}$$

What is claimed is:

1. A device for monitoring a fuel/air ratio of a mixture of air and fuel vapour being fed from the an outlet (34) of a fuel vapour accumulator (3), wherein the fuel vapour accumulator (3) receives a fuel vapour coming from a tank (7) at an inlet **(3*a*), and wherein the fuel vapour accumulator (3) is provided with air at an air inlet (3*b*) the fuel vapour accumulator (3) feeding at the outlet (34) the mixture of air and fuel vapour, the outlet (34) leading to an intake manifold (12) and to an engine (13)**, the device comprising:

electronic calculating means (16) for receiving and calculating, said electronic calculating means receiving as an input at least information of a flow rate of air Qa aspirated into said accumulator (3), said electronic calculating means calculating a flow rate of air Qa° which would be fed at the outlet from said accumulator (3) in the absence of fuel vapour coming from said accumulator (3), said electronic calculating means further calculating a percentage (p) of fuel vapour fed from the outlet of said accumulator, said percentage (p) of fuel vapour calculated on the basis of said flow rate of air Qa and said flow rate of air Qa°.

2. A device according to claim 1, wherein said electronic calculating means (16) calculates said percentage (p) as a function of the ratio Qa/Qa° between said flow rate of air Qa and said flow rate of air Qa°.

3. A device according to claim 1, wherein said electronic calculating means (16) calculates said percentage (p) in accordance with the expression:

$$p = 0.5\left[2 - \left(1 - \frac{\gamma v}{\gamma a}\right)\left(\frac{Qa}{Qa^0}\right)^2\right] - 0.5\sqrt{\left[2 - \left(1 - \frac{\gamma v}{\gamma a}\right)\left(\frac{Qa}{Qa^0}\right)^2\right]^2 - 4\left[1 - \left(\frac{Qa}{Qa^0}\right)^2\right]}$$

in which γa represents a specific weight of the air and γv represents a specific weight of the fuel vapour.

4. A device according to claim 1, wherein said electronic calculating means (16) calculates said flow rate of air Qa° by way of the expression:

$$Qa^0 = KA\sqrt{\frac{\Delta P}{\gamma a}}$$

in which ΔP represents a vacuum present in the intake manifold (12) connected to said accumulator (3), Δa represents a specific weight of the air, A represents a passage section of a cut-off valve (14) interposed between said accumulator (3) and said manifold (12) and K takes into account a duty cycle with which said cut-off valve (14) is controlled, the latter being adapted to throttle the flow of air and fuel vapour fed towards said intake manifold (12).

5. A method of monitoring a fuel/air ratio of a mixture of air and fuel vapour being fed from an outlet of a fuel vapour accumulator, the method comprising the steps of:

(a) detecting a flow rate of aspirated air Qa fed at an inlet to said accumulator (3), and (b) calculating a percentage (p) of fuel vapour in the mixture of air and fuel vapour fed from the outlet from said accumulator based on first calculating the flow rate of air Qa° which would be fed at the outlet from said accumulator (3) in the absence of fuel vapour coming from the accumulator (3), and then calculating said percentage (p) on the basis of said flow rate of air Qa and said flow rate of air Qa°.

6. A method according to claim 5, wherein said percentage (p) is calculated as a function of the ratio Qa/Qa° between said flow rate of air Qa and said flow rate of air Qa°.

7. A method according to claim 5, wherein said percentage (p) is calculated in accordance with the expression:

$$p = 0.5\left[2 - \left(1 - \frac{\gamma v}{\gamma a}\right)\left(\frac{Qa}{Qa^0}\right)^2\right] - 0.5\sqrt{\left[2 - \left(1 - \frac{\gamma v}{\gamma a}\right)\left(\frac{Qa}{Qa^0}\right)^2\right]^2 - 4\left[1 - \left(\frac{Qa}{Qa^0}\right)^2\right]}$$

in which γa represents a specific weight of the air and γv represents a specific weight of the fuel vapour.

8. A method according to claim 5, wherein said flow rate of air Qa° is calculated by way of the expression:

$$Qa^0 = KA\sqrt{\frac{\Delta P}{\gamma a}}$$

in which ΔP represents a vacuum present in the intake manifold (12) connected to said accumulator (3), γa represents a specific weight of the air, A represents a passage section of a cut-off valve (14) interposed between said accumulator (3) and said manifold (12) and K takes into account a duty cycle with which said cut-off valve (14) is controlled, the latter being adapted to throttle the flow of air and fuel vapour fed towards said intake manifold (12).

* * * * *